US011859327B2

(12) United States Patent
Kim

(10) Patent No.: US 11,859,327 B2
(45) Date of Patent: Jan. 2, 2024

(54) WASHING MACHINE, SYSTEM INCLUDING THE SAME, AND METHOD OF CONTROLLING WASHING MACHINE

(71) Applicant: Samsung Electronics Co., Ltd., Suwon-si (KR)

(72) Inventor: Chang Hoo Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 592 days.

(21) Appl. No.: 16/623,132

(22) PCT Filed: Apr. 4, 2018

(86) PCT No.: PCT/KR2018/003947
§ 371 (c)(1),
(2) Date: Dec. 16, 2019

(87) PCT Pub. No.: WO2018/230820
PCT Pub. Date: Dec. 20, 2018

(65) Prior Publication Data

US 2020/0173088 A1 Jun. 4, 2020

(30) Foreign Application Priority Data

Jun. 16, 2017 (KR) ..... 10-2017-0076398

(51) Int. Cl.
*D06F 33/47* (2020.01)
*D06F 33/37* (2020.01)
(Continued)

(52) U.S. Cl.
CPC ..... *D06F 33/47* (2020.02); *D06F 33/32* (2020.02); *D06F 33/37* (2020.02); *D06F 39/022* (2013.01);
(Continued)

(58) Field of Classification Search
CPC ..... D06F 33/32; D06F 33/52; D06F 34/04; D06F 34/05; D06F 33/47; D06F 39/022
See application file for complete search history.

(56) References Cited

U.S. PATENT DOCUMENTS

2001/0049948 A1* 12/2001 Jo ..... D06F 34/28 68/12.27
2007/0044819 A1* 3/2007 Chan ..... D06F 39/022 134/18

(Continued)

FOREIGN PATENT DOCUMENTS

EP 2067429 A1 * 6/2009 ..... A47L 15/4293
EP 2 573 247 A2 3/2013

(Continued)

OTHER PUBLICATIONS

Korean Office Action dated Jul. 15, 2021, issued in Korean Patent Application No. 10-2017-0076398.

(Continued)

*Primary Examiner* — Michael E Barr
*Assistant Examiner* — Kevin G Lee
(74) *Attorney, Agent, or Firm* — Jefferson IP Law, LLP

(57) ABSTRACT

The present disclosure is directed to providing a washing machine that can change a setting value stored in advance in the washing machine remotely from the outside, it is possible to quickly solve the problem without an engineer's visit in a counselling process with a user, and increase the user's satisfaction by reducing the time and cost waste, a system including the same and a method of controlling the washing machine. The washing machine includes a communicator configured to communicate with the outside; a storage configured to store a setting value; and a controller configured to change the setting value stored in the storage based on the setting value received by the communicator, and to control the washing machine based on the changed setting value.

5 Claims, 9 Drawing Sheets

(51) Int. Cl.

| | |
|---|---|
| ***D06F 33/32*** | (2020.01) |
| ***D06F 39/02*** | (2006.01) |
| *D06F 105/46* | (2020.01) |
| *D06F 105/42* | (2020.01) |
| *D06F 34/05* | (2020.01) |
| *D06F 105/58* | (2020.01) |
| *D06F 33/40* | (2020.01) |

(52) U.S. Cl.
CPC ..... *D06F 33/40* (2020.02); *D06F 34/05* (2020.02); *D06F 2105/42* (2020.02); *D06F 2105/46* (2020.02); *D06F 2105/58* (2020.02)

(56) References Cited

U.S. PATENT DOCUMENTS

| | | | | |
|---|---|---|---|---|
| 2011/0054843 | A1* | 3/2011 | Han | H04L 12/2825 702/185 |
| 2014/0156082 | A1* | 6/2014 | Ha | H04L 12/2818 700/275 |
| 2014/0236328 | A1 | 8/2014 | Kamon et al. | |
| 2015/0013074 | A1 | 1/2015 | Ficke et al. | |
| 2016/0215430 | A1* | 7/2016 | Ha | H04L 12/282 |
| 2017/0085390 | A1* | 3/2017 | Belveal | D06F 33/00 |
| 2018/0266036 | A1* | 9/2018 | Leibman | D06F 33/37 |

FOREIGN PATENT DOCUMENTS

| | | | |
|---|---|---|---|
| KR | 10-2012-0080082 | A | 7/2012 |
| KR | 10-2012-0080084 | A | 7/2012 |
| KR | 10-2013-0020376 | A | 2/2013 |
| KR | 10-2014-0122108 | A | 10/2014 |
| KR | 10-2015-0027643 | A | 3/2015 |
| KR | 10-2016-0010785 | A | 1/2016 |

OTHER PUBLICATIONS

Extended European Search Report dated Mar. 12, 2020, issued in a counterpart European Application No. 18818879.1-1016.

* cited by examiner

FIG. 8

| WASHING MACHINE FUNCTION | SETTING VALUE |
|---|---|
| DETERGENT INPUT FUNCTION | INPUT DETERGENT AMOUNT |
| CHILD PROTECTION FUNCTION | SETTING / RELEASE |
| MUTE FUNCTION | SETTING / RELEASE |
| LIGHT FUNCTION | SETTING / RELEASE |
| ANTI-ICING FUNCTION | DRIVING TIME,<br>SETTING / RELEASE |

WASHING MACHINE, SYSTEM INCLUDING THE SAME, AND METHOD OF CONTROLLING WASHING MACHINE

TECHNICAL FIELD

The present disclosure relates to a washing machine that can be controlled remotely by a manufacturer, a system including the same and a method of controlling the washing machine.

BACKGROUND ART

Generally, a washing machine is an apparatus for separating contaminants from laundry by applying energy such as an impact to laundry. The washing machine may be classified into a pulsator washing machine, an agitator washing machine, a drum washing machine, and the like according to a method of applying energy to the laundry.

Here, the pulsator washing machine is a method of washing by flow of water generated by rotating a disk-shaped pulsator. The agitator washing machine is a method of washing by rotating a wing-shaped stirrer to the left and right in the center of a washing tub. The drum washing is a method of washing the laundry by dropping the laundry by the rotation of a drum to apply the impact to the laundry.

As a technology has advanced, the aforementioned washing machines have added additional functions. After purchasing the washing machine, a user often operates the washing machine based on a setting value set at the time of purchase without carefully examining various added functions.

Meanwhile, a manufacturer of the washing machine installs a counselling center for the convenience of customers who purchase the washing machine, and receives a user's inquiry or fault history. The manufacturer decides an engineer's visit by estimating a fault based only on the user's contents.

However, some fault history can be solved by the user reading a manual and changing the setting value. However, it is frequently resolved by the engineer's visit through a connection of the counselling center. The engineer's visit was disadvantageous to the user and manufacturer in terms of time and cost.

DISCLOSURE

Technical Problem

The present disclosure is directed to providing a washing machine that can change a setting value stored in advance in the washing machine remotely from the outside, it is possible to quickly solve the problem without an engineer's visit in a counselling process with a user, and increase the user's satisfaction by reducing the time and cost waste, a system including the same and a method of controlling the washing machine.

Technical Solution

An aspect of the disclosure provides a washing machine including: a communicator configured to communicate with the outside; a storage configured to store a setting value; and a controller configured to change the setting value stored in the storage based on the setting value received by the communicator, and to control the washing machine based on the changed setting value.

The storage may be configured to store a usage history of the washing machine.

The controller may be configured to control the communicator to transmit the stored usage history to the outside based on a request signal received by the communicator.

The washing machine may further include a drum; a detergent box configured to contain a detergent; and a detergent input motor configured to transmit the contained detergent into the drum. The controller may be configured to adjust the amount of detergent inputted by the detergent input motor based on the changed setting value.

The washing machine may further include a main body; a door installation part having a front surface of the main body opened; a door connected to the main body to open and close the door installation part; and a LED driver configured to emit light provided on one side of the door installation part. The controller may be configured to control the LED driver based on the changed setting value.

The washing machine may further include a sound outputter configured to output a sound. The controller may be configured to control on and off of the sound outputter based on the changed setting value.

The washing machine may further include a drum; and a driving motor configured to rotate the drum. The controller may be configured to adjust a reservation time for controlling the driving motor based on the changed setting value.

The washing machine may further include a door switch configured to selectively restrain an operation of the door when the door is closed. The controller may be configured to control the door switch based on the changed setting value.

Another aspect of the disclosure provides a system including: a washing machine; and a server configured to identify a fault history of the washing machine, and to provide a solution according to fault contents. The washing machine may further include a communicator configured to communicate with the server; a storage configured to store a setting value; and a controller configured to change the setting value stored in the storage based on the setting value received by the communicator, and to control the washing machine based on the changed setting value.

The system may further include a user terminal configured to transmit a signal related to the control of the washing machine to the communicator through pairing.

The storage may be configured to store a usage history of the washing machine.

The controller may be configured to control the communicator to transmit the stored usage history to the outside based on a request signal transmitted from the server.

The server may be configured to determine whether to change the setting value based on the fault history and a usage history.

The controller may be configured to determine whether the server is authorized to change the setting value.

Another aspect of the disclosure provides a method of controlling a washing machine including: storing, by a storage, a setting value related to a function of the washing machine; receiving, by a communicator, a change signal of the setting value from the exterior; changing, by a controller, the stored setting value based on the change signal; and controlling, by the controller, the washing machine based on the changed setting value.

Advantageous Effects

According to the above-described washing machine, the system including the same and the method of controlling the washing machine, by providing the plurality of washing apparatuses, it is possible to change the setting value stored in advance in the washing machine remotely from the outside, so that the user can quickly solve the problem without visiting the engineer during the consultation with the user, and reduce the time and cost waste to increase the user's satisfaction.

DESCRIPTION OF DRAWINGS

FIG. 8 is a view illustrating a function of changing a setting value from the outside of a washing machine according to an embodiment.

MODES OF THE INVENTION

Figure 1:
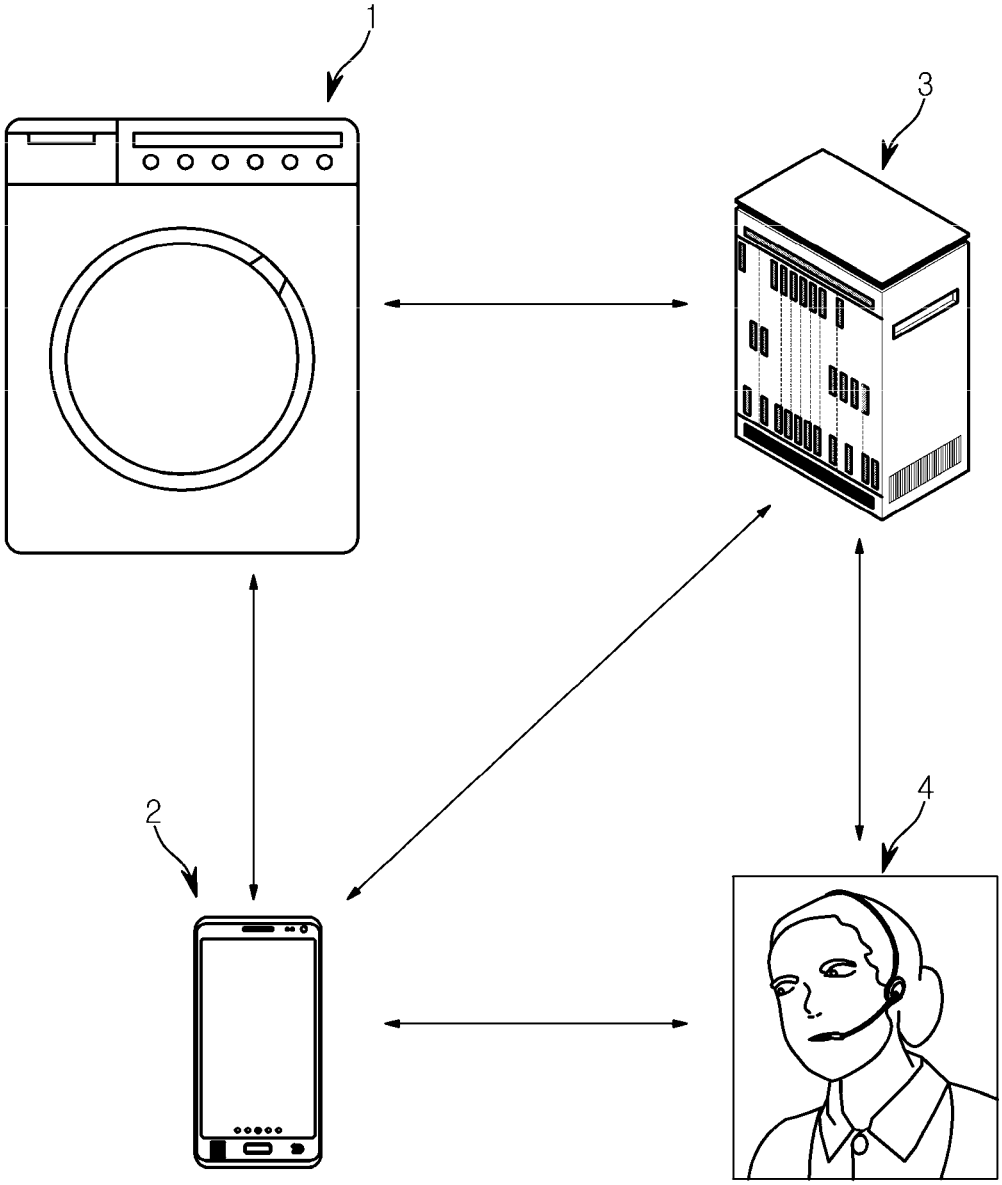
FIG. 1 is a view illustrating a system according to an embodiment.

Like reference numerals refer to like elements throughout the specification. Not all elements of exemplary embodiments of the disclosure will be described, and description of what are commonly known in the art or what overlap each other in the embodiments will be omitted. The terms as used throughout the specification, such as "~part," "~module," "~member," "~block," etc., may be implemented in software and/or hardware, and a plurality of "~parts," "~modules," "~members," or "~blocks" may be implemented in a single element, or a single "~part," "~module," "~member," or "~block" may include a plurality of elements.

It will be understood that when an element is referred to as being "connected" to another element, it can be directly or indirectly connected to the other element, wherein the indirect connection includes "connection" via a wireless communication network.

Also, when a part "includes" or "comprises" an element, unless there is a particular description contrary thereto, the part may further include other elements, not excluding the other elements.

As used herein, the singular forms "a," "an" and "the" are intended to include the plural forms as well, unless the context clearly indicates otherwise.

An identification code is used for the convenience of the description but is not intended to illustrate the order of each step. Each of the steps may be implemented in an order different from the illustrated order unless the context clearly indicates otherwise.

The principle and exemplary embodiments of the present disclosure will now be described with reference to the accompanying drawings.

FIG. 1 is a view illustrating a system according to an embodiment.

Referring to FIG. 1, a system 5 may include a washing machine 1, a user terminal 2, and a server 3. Each component of the system 5 may be connected to each other through wired and wireless communication.

The washing machine 1 may communicate with the user terminal 2 and the server 3 through the wired and wireless communication. The washing machine 1 may receive a setting value transmitted by the user terminal 2 or the server 3. The washing machine 1 may change a preset initial value based on the received setting value.

The user terminal 2 may remotely control the washing machine 1. Particularly, the user terminal 2 may control an operation of the washing machine 1 after pairing with the washing machine 1. In addition, the user terminal 2 may receive a usage history from the washing machine 1, and may transmit the usage history received to the server 3.

The server 3 may collect the usage history transmitted by the washing machine 1 or the user terminal 2. In addition, the server 3 may analyze a fault history that may occur in the washing machine 1 based on the collected usage history.

For example, the server 3 may analyze the fault history of the washing machine 1 only through a rule engine. That is, the server 3 may analyze an individual fault history based on the usage history of each of the washing machines 1, rather than providing a solution through a consistent fault history and a predetermined scenario of a manufactured product.

The server 3 may transmit the fault history and the solution to a service center 4.

The fault history and the solution may be divided into two cases, which can be solved by an engineer visiting and that can be solved by changing the setting value.

When the user requests the service according to a fault of the washing machine 1, the service center 4 may transmit the solution analyzed by the server 3 to the user. When the inquired fault history can be solved only by changing the setting value, the service center 4 may instruct the change of the setting value of the washing machine 1 through the server 3. This may prevent unnecessary dispatch of the engineer.

The user terminal 2 may be implemented as a computer or a portable terminal capable of connecting to the washing machine 1 through a network. The computer may include, for example, a notebook, a desktop, a laptop, a tablet PC, a slate PC, and the like, each of which is equipped with a WEB Browser. The user terminal 2 may include, for example, a wearable device such as a Personal Communication System (PCS), or the like as a wireless communication device that is guaranteed to be portable and mobile. The portable terminal may be any type of handheld-based wireless communication device such as a Personal Communication System (PCS), Global System for Mobile communications (GSM), Personal Digital Cellular (PDC), Personal Handyphone System (PHS), Personal Digital Assistant (PDA), International Mobile Telecommunications (IMT)-2000, Code Division Multiple Access (CDMA)-2000, W-Code Division Multiple Access (W-CDMA), Wireless Broadband (WiBro) Internet terminal, a vehicle smart key, a smart phone, etc., a wearable device such as a watch, a ring, a bracelet, an anklet, a necklace, a pair of glasses, and contact lens, or a head-mounted-device (HMD).

In the above, as an example of the system 5, the case including the washing machine 1, the user terminal 2, and the server 3 has been described. However, it is not necessary to include all components, and the washing machine 1 is provided through the network. When it is instructed to change the setting value and the washing machine 1 can change the setting value, it is sufficient and there is no limit.

Hereinafter, various configurations of applying the setting value changed by the washing machine 1 through FIGS. 2 to 4 will be described.

Figure 2:
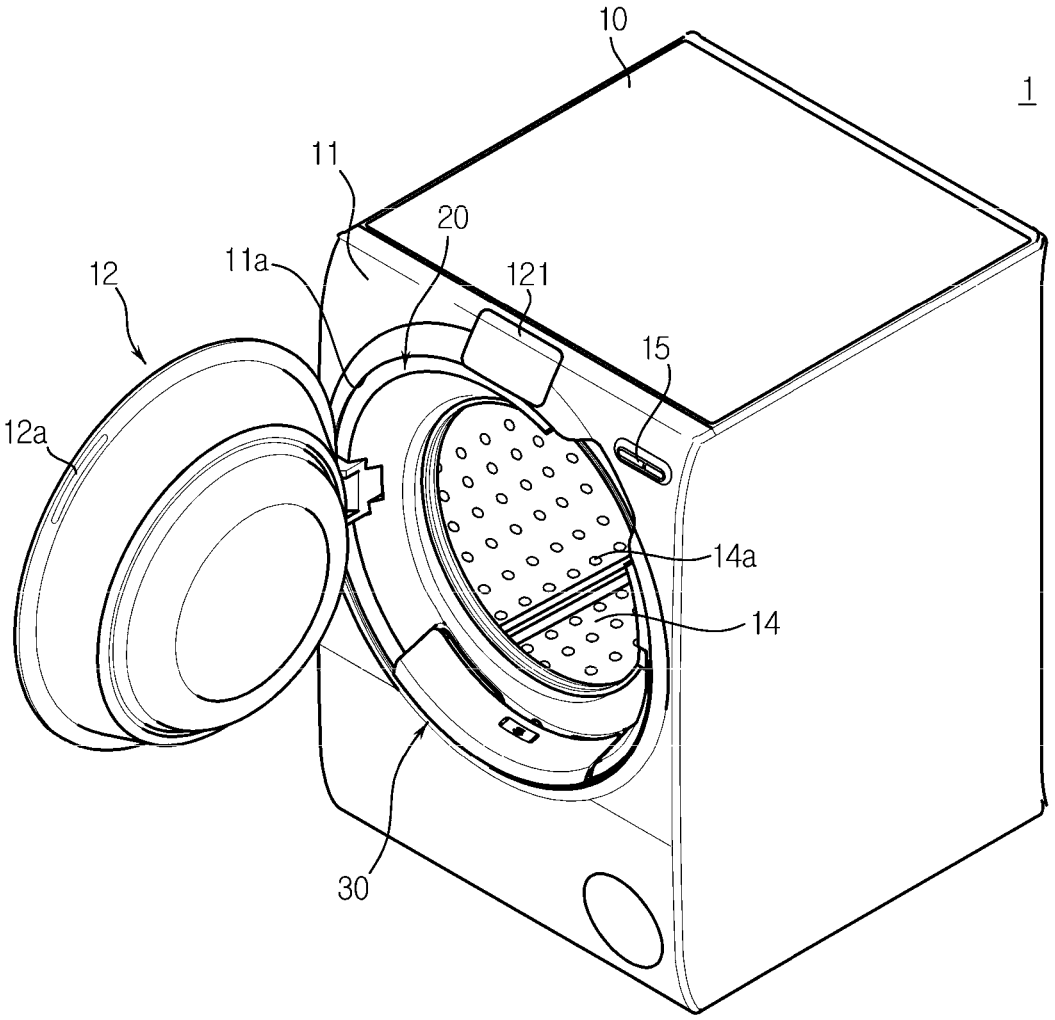
FIG. 2 is a perspective view illustrating a washing machine according to an embodiment.
Figure 3:
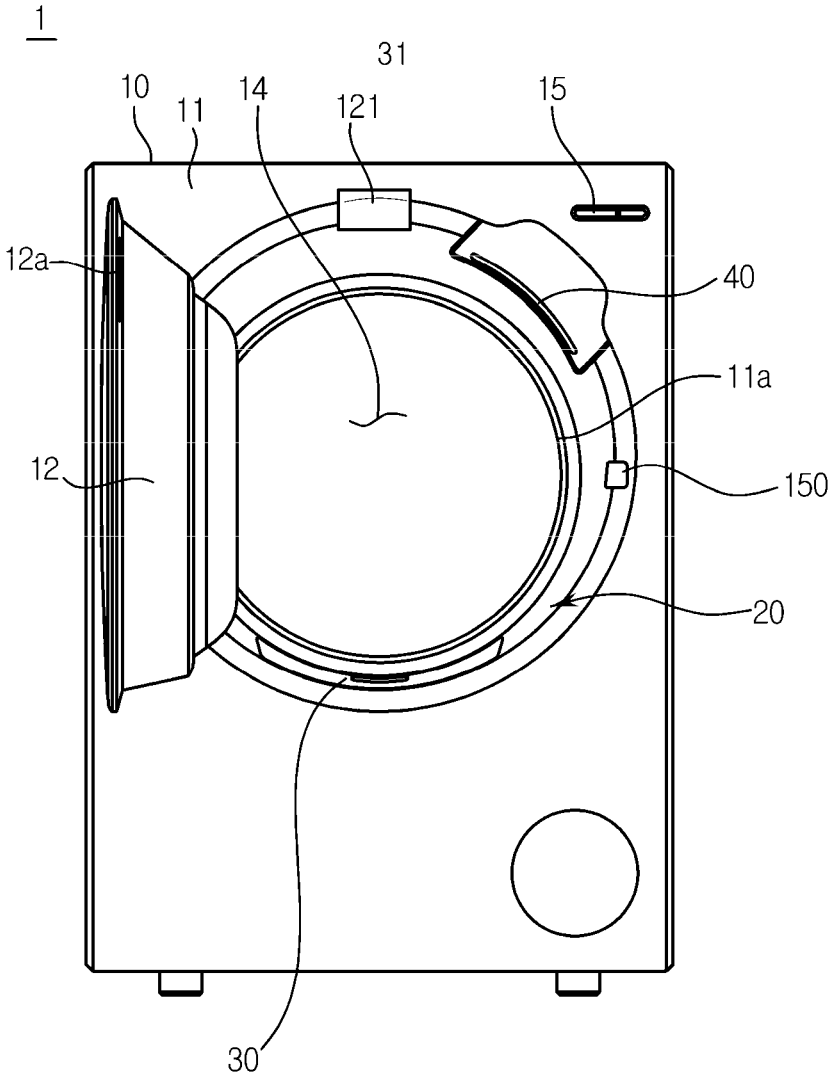
FIG. 3 is a front view of the washing machine according to an embodiment.

FIG. 2 is a perspective view illustrating a washing machine according to an embodiment, and FIG. 3 is a front view of the washing machine according to an embodiment. In order to avoid overlapping description, it describes together below.

Referring to FIGS. 2 and 3, the washing machine 1 is a drum washing machine. However, the embodiment of the washing machine 1 is not necessarily limited to the drum washing machine.

The washing machine 1 may include a main body 10 forming an exterior, a tub 13 installed inside the main body 10 and storing wash water, and a cylindrical drum 14 rotatably installed inside the tub 13 and having a plurality of dehydration holes 14*a* formed on a wall thereof.

A display 121 may be provided at an upper end of a front surface 11 of the main body 10 to display information related to a washing process and the usage history of the washing machine 1. In addition, various keys 15 for turning on/off a power of the washing machine 1 or receiving a user's control command may be provided at an upper right side of the front surface 11.

The front surface 11 of the main body 10 may be formed an opening 11 a so that laundry for washing can be put into or taken out of the tub 13 and the drum 14, and may be provided a door 12 to open and close the opening 11 a of the main body 10.

The opening 11 a may be provided with a door installation part 20 to allow the door 12 to be seated to close the opening 11 a. The door installation part 20 may be provided in a shape corresponding to a frame forming a rear surface of the door 12.

In addition, the door installation part 20 may be provided in a circular ring shape in the center, and may include a detergent box 30 formed by partially cutting the bottom surface of the door installation part 20 on which the rear of the door 12 may be seated.

The detergent box 30 may store a predetermined amount of detergent, and transmit the input amount set through a detergent input motor 132 which will be described later to the drum 14. The washing machine 1 may adjust a detergent input amount of the detergent box 30 based on the setting value transmitted from the user terminal 2 or the server 3.

The door installation part 20 may be provided with a lighting device 40 for visually displaying a washing progress state of the start, operation and end of the washing.

The door 12 may be surface-treated with a chromium material having a high reflectance so as to enhance a reflection and diffusion effect of light emitted from the lighting device 40. In addition, the door 12 may include a glass provided to be inserted into the main body 10 in the center of the frame provided to form the exterior. The user may identify the inside of the drum 14 through the light emitted by the lighting device 40.

The lighting device 40 may emit light by a LED module 122 described later. In particular, the washing machine 1 may switch the operation of the lighting device 40 based on the setting value transmitted from the user terminal 2 or the server 3.

A handler 12*a* may be provided on an upper right side of the door 12 to allow the user to open and close the door 12 by holding the door 12. The lighting device 40 may guide a position of the handler 12*a* through the light emitted.

The door installation part 20 may be provided with a door switch 150 for detecting the opening and closing of the door 12 and locking the door 12 to prevent opening and closing of the door 12 during the operation of the washing machine 1. The door switch 150 may switch the operation based on the setting value transmitted from the user terminal 2 or the server 3.

Figure 4:
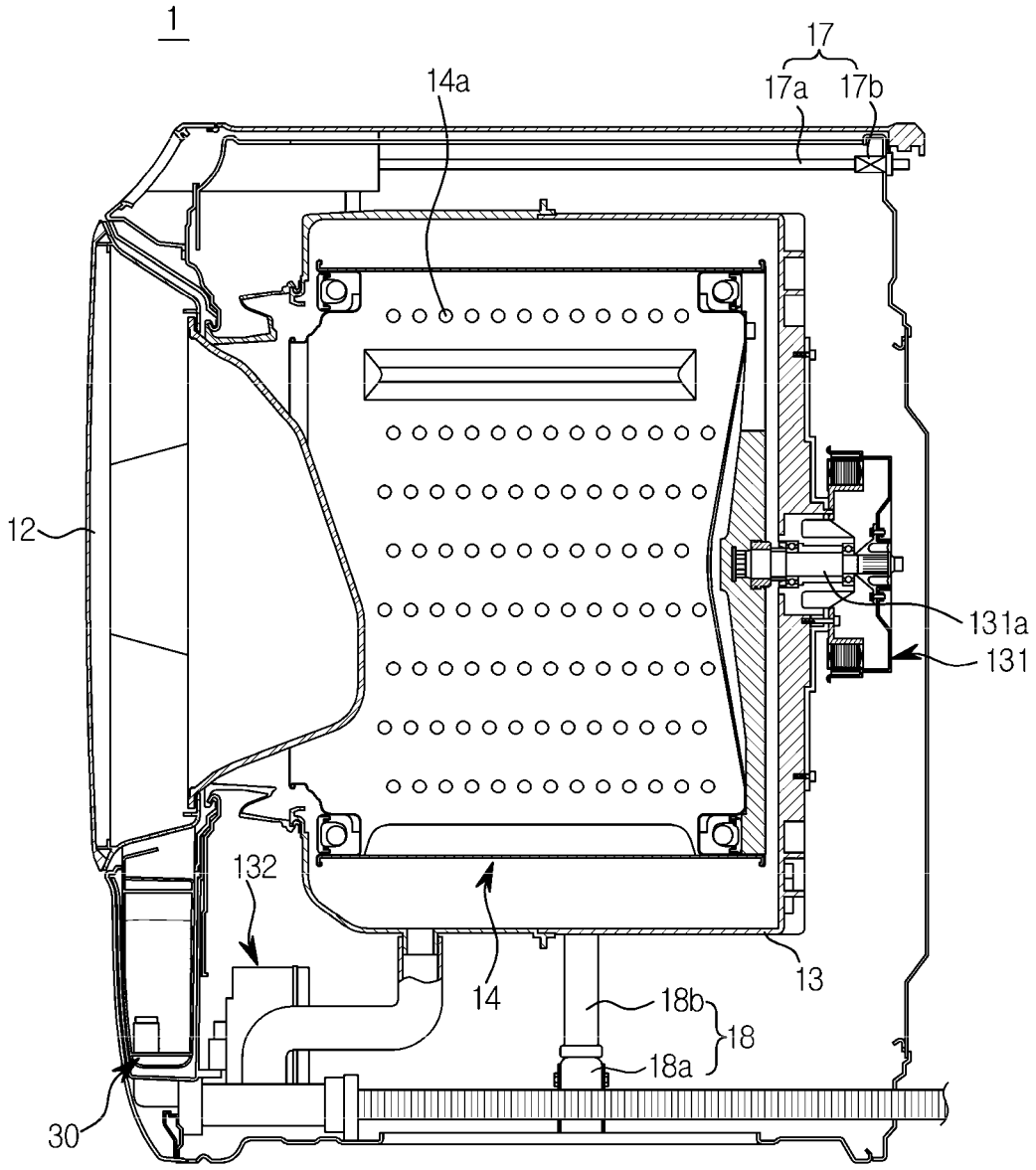
FIG. 4 is a side view of a washing machine according to an embodiment.

FIG. 4 is a side view of a washing machine according to an embodiment.

Referring to FIG. 4, the inside of the main body 10 may include the tub 13, the drum 14, a water supply device 17, a drainage device 18, and the detergent box 30. The inside of the main body may include a driving motor 131 for rotating the drum 14 and the detergent input motor 132 for inputting the detergent of the detergent box 30 into the drum 14.

Particularly, the tub 13 is fixedly installed in the main body 10 to accommodate the wash water supplied from the water supply device 17. The outside of the tub 13 may be mounted with the driving motor 131 for rotating the drum (14).

The drum 14 may be provided to correspond to the shape of the tub 13 and may be located inside the tub 13. A rotating shaft 131*a* may be provided outside the drum 14. The rotating shaft 131*a* may extend to the outside of the tub 13 and may be connected to the driving motor 131 mounted to the outside of the tub 13. The drum 14 may rotate clockwise or counterclockwise within the tub 13.

The driving motor 131 operates during the washing process, a rinsing process, and a dehydration process under the control of a controller 100 described with reference to FIG. 5. Particularly, when the sensing device 90 detects the weight of the laundry in the drum 14, the driving motor 131 may be rotated based on a signal of the controller 100. The drum 14 may rotate by a driving force transmitted by the driving motor 131, and the laundry in the drum 14 is washed, rinsed, and dehydrated.

The water supply device 17 may include a water supply pipe 17*a* and a water supply valve 17*b*.

The water supply pipe 17*a* is connected to a water pipe to transmit water supplied from the outside to the drum 14. The water supply valve 17*b* may adjust the amount of water supplied under the control of the controller 100. In the washing machine 1, the amount of water supplied may be adjusted based on the setting values received by the user terminal 2 and the server 3.

On the other hand, when the water supply device 17 supplies water, the detergent provided in the detergent box 30 may be supplied together to the drum 14 by the detergent input motor 132. The user may input a sufficient amount of detergent in advance of the detergent box 30. The controller 100 may control the detergent input motor 132 to adjust the amount of detergent supplied to the drum 14 each time the washing process starts. The input amount may be changed by the user terminal 2 or the server 3.

The drainage device 18 may include a pump 18*a* and a drain pipe 18*b*. The pump 18*a* may pump the wash water inside the tub 13 and the drum 14 during the draining and dehydrating process. The drain pipe 18*b* may be provided below the tub 13 to guide the wash water pumped by the pump 18*a* to the outside.

On the other hand, the washing machine 1 may include a variety of configurations in addition to, there is no limitation.

Figure 5:
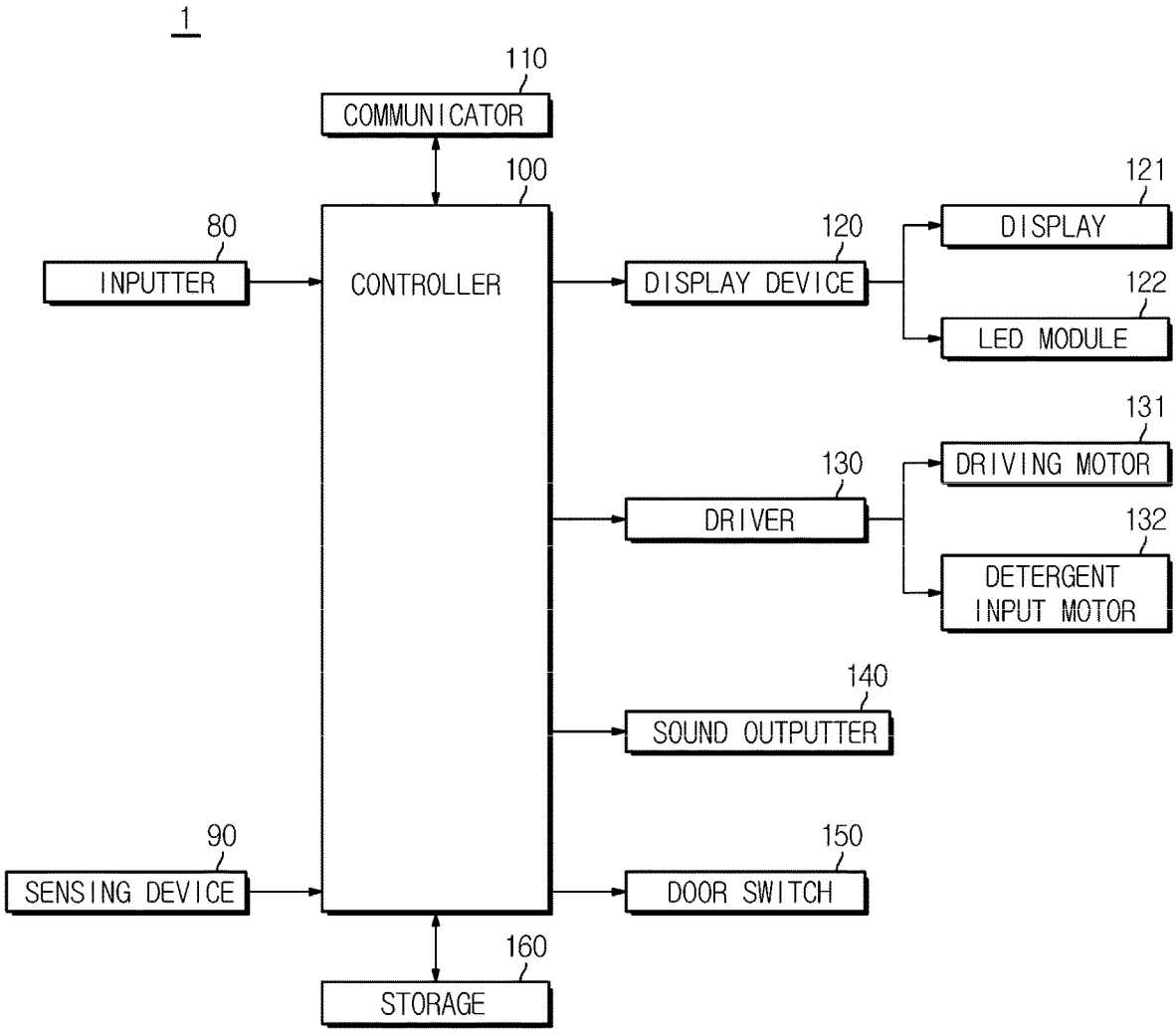
FIG. 5 is a control block diagram of a washing machine according to an embodiment.

FIG. 5 is a control block diagram of a washing machine according to an embodiment.

Referring to FIG. 5, the washing machine 1 may include an inputter 80 for receiving the user's control command, the sensing device 90 for detecting the input of the laundry, and the like, and includes a plurality of sensors, a communicator 110 for communicating with the outside, a display device 120 for displaying the washing process and other interfaces of the washing machine 1, a driver 130 for controlling the driving motor 131, a sound outputter 140 for outputting sound, the door switch 150 for performing a locking function of the door 12, a storage 160 for storing the usage history and the setting value, and a controller 100 for collectively controlling the above-described configurations In detail, the inputter 80 may receive the user's control command. For example, the inputter 80 may be connected to a power button for turning on/off the power of the washing machine 1 and a button for starting or pausing the operation of the washing machine 1 to receive the control command. In addition, the inputter 80 may adjust the amount of detergent input into the detergent box 30 and may receive a locking command of the door 12 according to a child protection function. In addition, the inputter 80 may receive the control command of the sound outputter 140 from the user a mute function and an on/off command of the LED module 122 from the user for a light function.

Meanwhile, the inputter 80 may include hardware devices such as various buttons, keyboards, track-balls, various levers, handles, sticks, or the like for user input. In addition, the inputter 80 may include a graphical user interface (GUI) such as a touch pad for user input, that is, a software device. The touch pad may be implemented as a touch screen panel (TSP) to form a mutual layer structure with the display.

The sensing device 90 includes various sensors included in the washing machine 1, and when laundry is input into the drum 14, the sensing device 90 may detect the weight of the laundry. In addition, the sensing device 90 may detect the amount of detergent that is input into the detergent box 30 and the detergent moves to the drum 14.

The communicator 110 may exchange data with the user terminal 2 and/or the server 3 described in FIG. 1 through a network.

The communicator 110 may transmit data on the usage history and errors of the washing machine 1 to the outside. In addition, the communicator 110 may receive the setting value transmitted by the user terminal 2 or the server 3 and transmit the setting value to the controller 100.

The communicator 110 may include one or more components that enable the aforementioned communication, for example, at least one of a short-range communication module, a wired communication module, and a wireless communication module.

The short-range communication module may include various short-range communication modules for transmitting and receiving signals within a short range over a wireless communication network, such as a Bluetooth module, an infrared communication module, a radio frequency identification (RFID) communication module, a wireless local access network (WLAN) communication module, a near field communication (NFC) module, a Zigbee communication module, etc.

The wired communication module may include not only one of the various wired communication modules, such as a local area network (LAN) module, a wide area network (WAN) module, or a value added network (VAN) module, but also one of various cable communication modules, such as a universal serial bus (USB), a high definition multimedia interface (HDMI), a digital visual interface (DVI), recommended standard (RS) 232, a power cable, or a plain old telephone service (POTS).

The wireless communication module may include a wireless fidelity (WiFi) module, a wireless broadband (WiBro) module, and/or any wireless communication module for supporting various wireless communication schemes, such as a global system for a mobile communication (GSM) module, a code division multiple access (CDMA) module, a wideband code division multiple access (WCDMA) module, a universal mobile telecommunications system (UMTS), a time division multiple access (TDMA) module, a long-term evolution (LTE) module, etc.

The wireless communication module may include a wireless communication interface including an antenna and a transmitter for transmitting a signal related to the usage history. The wireless communication module may further include a signal conversion module for converting a digital control signal output from the controller 600 through the wireless communication interface to an analog wireless signal under the control of the controller 600.

The wireless communication module may include a wireless communication interface including an antenna and a receiver for receiving a signal related to the setting value. The wireless communication module may further include a signal conversion module for converting an analog wireless signal received through the wireless communication interface to a digital control signal.

The display device 120 may be an output device for connecting the washing machine 1 and the user, and may include the display 121 and the LED module 122.

In detail, the display device 120 may visually display the output device transmitted by the controller 100 through the display 121. For example, when the operation of the washing machine 1 is the dehydrating process, the display 121 may display an icon related to the dehydrating process and a time taken for the dehydrating process.

The display 121 may induce the user by displaying an icon or text related to a function that the washing machine 1 may perform, for example, a detergent input function, a child protection function, the mute function, a light function, and an anti-icing function. A detailed description thereof will be described later with reference to FIG. 8.

The display 121 may include a cathode ray tube (CRT), a digital light processing (DLP) panel, a plasma display penal, a liquid crystal display (LCD) panel, an electroluminescence (EL) panel, an electrophoretic display (EPD) panel, an electrochromic display (ECD) panel, a light emitting diode (LED) panel, or an organic light emitting diode (OLED) panel, etc., but is not limited thereto.

When the display 121 is implemented by the TSP having the mutual layer structure with the touch pad, the display 121 may also be used as the inputter 80.

The LED module 122 is included in the lighting device 40 described above with reference to FIG. 3, and visually displays the progress state of the start, operation, and end of washing under the control of the controller 100 using dimming.

In detail, the LED module 122 may be turned on when the power of the washing machine 1 is turned on to guide the position of the handler 12*a*. In addition, the LED module 122 may light up for a predetermined time at the end of the process to display the process and guide the position of the handler 12*a*.

In addition, the LED module 122 may blink at a constant speed or at a predetermined time interval to transmit the progress state of the washing machine 1 and the situation inside the drum 14 to the user.

In addition to the display 120, other visual information may be transmitted, and there is no limitation.

The driver 130 may include the hardware device for converting an electrical force transmitted to the washing machine 1. In detail, the driver 130 may include the driving motor 131 rotating the drum 14 and the detergent input motor 132 transmitting the detergent of the detergent box 30 to the drum 14.

The driving motor 131 may operate according to the washing, rinsing, and dehydrating process, and the operation speed and time may vary depending on the signal transmitted from the controller 100. In addition, the driving motor 131 may be driven under the control of the controller 100 for the anti-icing function.

The detergent input motor 132 may operate based on the input amount transmitted by the controller 100 before the washing process starts. That is, the amount of detergent input according to the operation time of the detergent injecting motor 132 is adjusted.

The sound outputter 140 may be configured to acoustically connect the washing machine 1 and the user, and may output the sound, a voice guide, etc. to the user through a speaker.

In detail, the sound outputter 140 may output various states related to the progress of a washing course and the operation of the washing machine 1 through various sounds. For example, when the controller 100 receives the setting value regarding the limitation of a sound output from the outside or receives a mute command from the user, the sound outputter 140 may reduce or turn off the volume of the output sound.

The door switch 150 may lock the door 12 as described with reference to FIGS. 2 and 3. Particularly, the door switch 150 may lock so that the door 12 cannot be opened when the washing process starts. When the washing process starts in the washing machine 1, water may be supplied into the drum 14. When the user opens the door 12 without inputting a pause or the like, the water supplied to the drum 14 may be poured out. To prevent this, the door switch 150 may lock the door 12 according to the signal of the controller 100.

The door switch 150 may switch the locking on/off based on the setting value received by the communicator 110.

The storage 160 may stores various data processed by the controller 100. In detail, the storage 160 may store an initial setting value required for the operation of each component of the washing machine 1.

When communicator 110 transmits a new setting value, the storage 160 may replace the stored initial setting value with the received setting value and store the received setting value. The newly stored setting value may be transmitted under the control of the controller 100 and may be reflected in a next operation.

In addition, the storage 160 may store the usage history of the washing machine 1, and transmit the stored usage history to the communicator 110 in accordance with a request signal of the server 3. The transmitted usage history may be used by the server 3 to come up with the solution in response to the user's inquiry about the fault.

The storage 160 may be implemented with at least one of a non-volatile memory device, such as a cache, Read Only Memory (ROM), Programmable ROM (PROM), Erasable Programmable ROM (EPROM), and Electrically Erasable Programmable ROM (EEPROM), a volatile memory device, such as Random Access Memory (RAM), or a storage medium, such as Hard Disk Drive (HDD) and Compact Disk (CD) ROM, without being limited thereto. The storage 160 may be the memory implemented as a chip separate from the processor such as the controller 100, and may be implemented as the single chip with the processor.

The controller 100 may be a microcomputer that controls the overall operation of the washing machine 1 such as the washing, rinsing, and dehydration according to the control command received through the inputter 80, which controls the display device 120, the door switch 150, and other loads (e.g., the pump, the valve, and a heater) to perform a washing program.

During the washing program, the controller 100 may store the usage history including the collected usage count and the fault history according to an occurrence of an error to the storage 160.

The controller 100 may change the initial setting value or previously stored setting value of each of the above-described components based on a signal according to the setting value change from the communicator 110. The controller 100 may controls each component based on the changed setting value. Through this, the user may easily change the operation of the washing machine 1 suspected of the fault, and the manufacturer may benefit an economic time by reducing the number of engineer visits.

Meanwhile, the controller 100 may be implemented with a memory storing an algorithm to control operation of the components in the washing machine 1 or data about a program that implements the algorithm, and a processor carrying out the aforementioned operation using the data stored in the memory. The memory and the processor may be implemented in separate chips. Alternatively, the memory and the processor may be implemented in a single chip.

The washing machine 1 may further include other components in addition to the components described with reference to FIG. 5, and there is no limitation.

Figure 6:
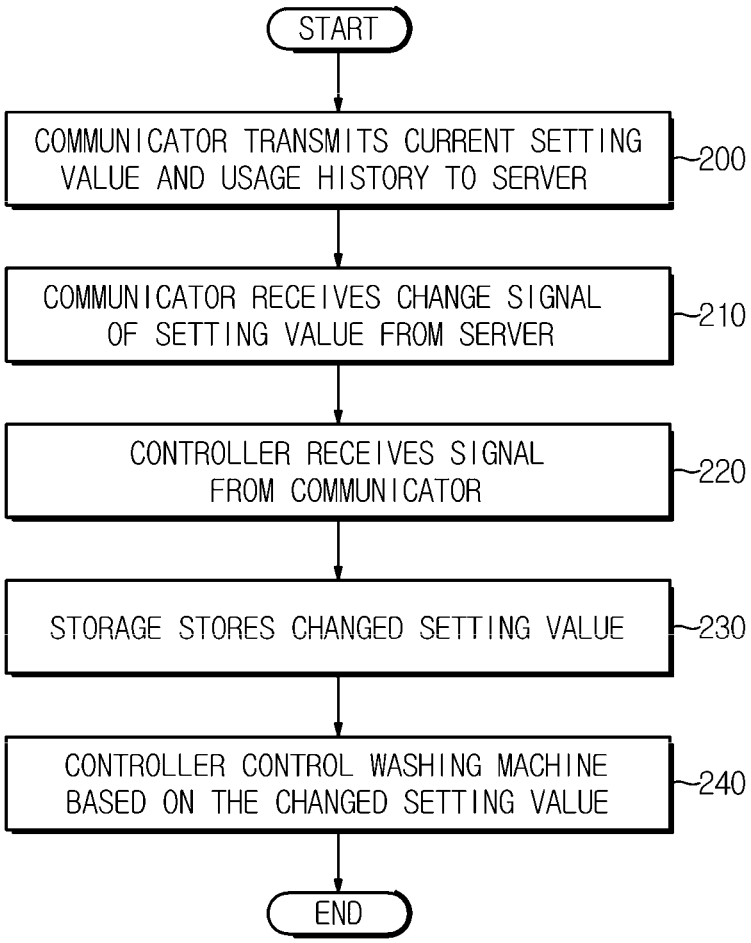
FIG. 6 is a flowchart illustrating an operation of a washing machine according to an embodiment.

FIG. 6 is a flowchart illustrating an operation of a washing machine according to an embodiment.

Referring to FIG. 6, the communicator 110 may transmit the setting value and the usage history currently stored in the storage 160 to the server 3 (200).

An object to which the communicator 110 transmits data is not necessarily limited to the server 3. For example, the user terminal 2 may receive the data transmitted by the communicator 110 and transmit the data to the server 3. That is, the communicator 110 may transmit the stored setting value and usage history to the outside of the washing machine 1.

Thereafter, the communicator 110 may receive the signal about changing the setting value from the server 3 (210).

The server 3 may determine the solution regarding the user's fault inquiry based on a current setting value and the usage history of the washing machine 1. The solution is that the manufacturer's engineer may visit in to replace the configuration, but in some cases it can be solved only by changing the setting value.

In the latter case, the server 3 may transmit the signal regarding the change of setting value to the washing machine 1 through the network.

On the other hand, the object to which a setting value change signal is transmitted to the communicator 110 is not necessarily limited to the server 3, and a configuration having an authority to change the setting value of the washing machine 1 such as the user terminal 2 is sufficient.

The controller 100 may receive the change signal transmitted from the communicator 110 (220).

The controller 100 may determine whether to change the setting value based on the change signal transmitted from the communicator 110. In detail, the controller 100 may determine whether the signal is authorized to change the setting value of the washing machine 1. When the signal includes a change authority, the controller 100 may determine whether to change the setting value for which function of the washing machine 1.

When the setting value is changed, the controller 100 may store the changed setting value in the storage 160 (230).

The controller 100 may newly store the setting value before the change as the usage history.

The controller 100 may control the washing machine 1 based on the changed setting value (240).

To this end, the manufacturer may remotely adjust the setting value of the washing machine 1, so there is no need to dispatch the engineer for each inquiries, so that the economic and time benefits may be obtained. The user may also easily adjust the washing machine 1 through the user terminal 2 or the like, thereby increasing the convenience and satisfaction of the user.

A method or a function of controlling the washing machine 1 may vary, and a description thereof will be described later with reference to FIG. 8.

Figure 7:
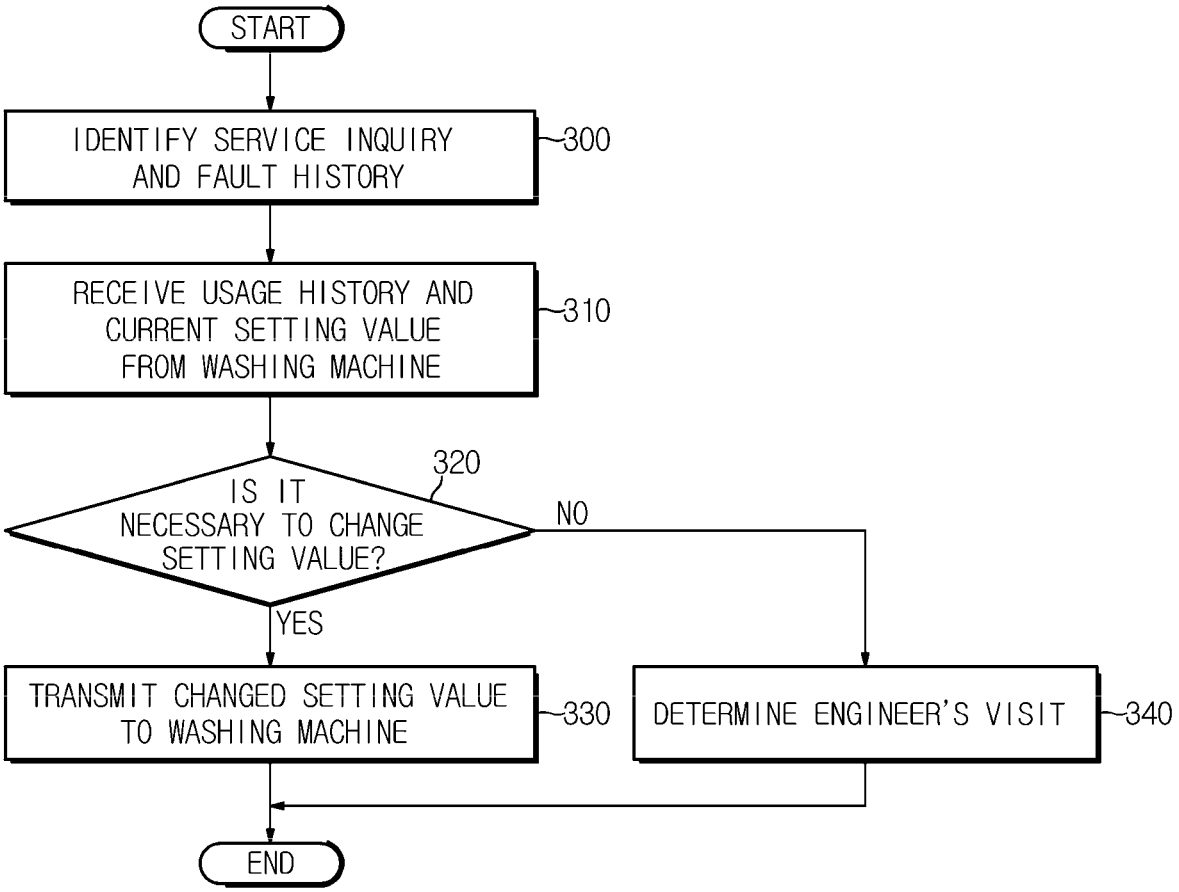
FIG. 7 is a flowchart illustrating a determination process for determining to change a setting value in a server.

FIG. 7 is a flowchart illustrating a determination process for determining to change a setting value in a server.

Referring to FIG. 7, the server 3 may identify a service inquiry and the fault history (300).

The service inquiry may be a consultation according to a telephone call or a visit of the user and a counselor of the service center 4 provided by the manufacturer, and may include the stored consultation contents. The fault history may be a question of the user and may include the fault history of the washing machine 1 considered by the user.

The server 3 may classify the consultation contents and the fault history and receive the usage history and the current setting value from the washing machine 1 (310).

The server 3 does not determine the engineer's visit by a program written consistently according to a product type of the washing machine 1. That is, the server 3 may seek the solution regarding the fault history based on the situation of the individual washing machine 1.

On the other hand, as described above, the usage history and the current setting value may be made through a communication network.

The server 3 may determine whether the setting value change is necessary (320).

That is, the current fault contents of the washing machine 1 may be a serious fault requiring the engineer's visit, and may be the fault that can be easily solved only by changing the initial setting value.

For example, the user may not be aware of the function of adjusting the input amount of the washing machine 1 to automatically input the predetermined amount of detergent. The user may apply for counselling after determining that washing is not performed smoothly due to lack of the detergent amount in several washing processes.

The server 3 may identify the number of operations and the currently stored setting value of the usage history of the washing machine 1 through the communication. The server 3 may determine that it is necessary to change the input amount of the detergent amount.

The server 3 may instruct the washing machine 1 to change the setting value (330).

The changed setting value may be directly transmitted by the server 3 to the washing machine 1, and may transmit a guide on the change and the control signal to the user terminal 2 together with and finally transmit a command regarding the change of the setting value to the washing machine 1.

When the fault is not solved only by changing the setting value, the server 3 may determine the engineer's visit (340).

FIG. 8 is a view illustrating a function of changing a setting value from the outside of a washing machine according to an embodiment.

Referring to FIG. 8, the washing machine 1 may perform the detergent input function, the child protection function, the mute function, the light function, and the anti-icing function.

Particularly, the detergent input function may be a function used for washing process by inputting a predetermined input amount of a large amount of detergent prepared in advance in the detergent box. That is, the controller 100 may operate the detergent input motor 132 on the basis of a preset input amount to input the detergent into the washing process.

In the detergent input function, the setting value stored in the storage 160 may be the amount of detergent input. That is, when the communicator 110 receives the setting value change, the controller 100 may change the amount of detergent input.

The child protection function may be the locking function that prevents the door 12 from being opened by a person who lacks cognitive ability such as a child while the drum 14 rotates, such as the washing, rinsing, and dehydration.

The controller 100 may change on/off, that is, setting and release of the child protection function according to the setting value change signal received from the outside.

The mute function may be a function in which the washing machine 1 limits the sound output of the sound outputter 140 for communicating with the user. The washing machine 1 may limit the output of the sound outputter 140 in addition to the on/off of hardware buttons provided by the inputter 80 or the touch of the touch screen.

The light function may be a function of emitting light so that the washing machine 1 can identify the situation inside the drum 14 through a glass provided in the door 12. As a specific example, the controller 100 may control the LED module 122 provided in the door installation part 20 to perform the light function.

On the other hand, the user can make the fault inquiry on the ground that the light of the washing machine 1 does not come on without identifying the light function guided by the manual. The server 3 may identify the usage history and the current light function off, and transmit the setting value for turning on the light function to the washing machine 1.

The anti-icing function may be a function in which the controller 100 operates the driving motor 131 for a preset reservation time in order to prevent the drum 14 or the water supply device 17 of the washing machine 1 from freezing.

The washing machine 1 may change the drive time for preventing frost and the setting value for setting/release, based on an external signal.

Meanwhile, the disclosed example is not limited to the function described in FIG. 8 or the name of the function, and may include various functions and setting values.

Figure 9:
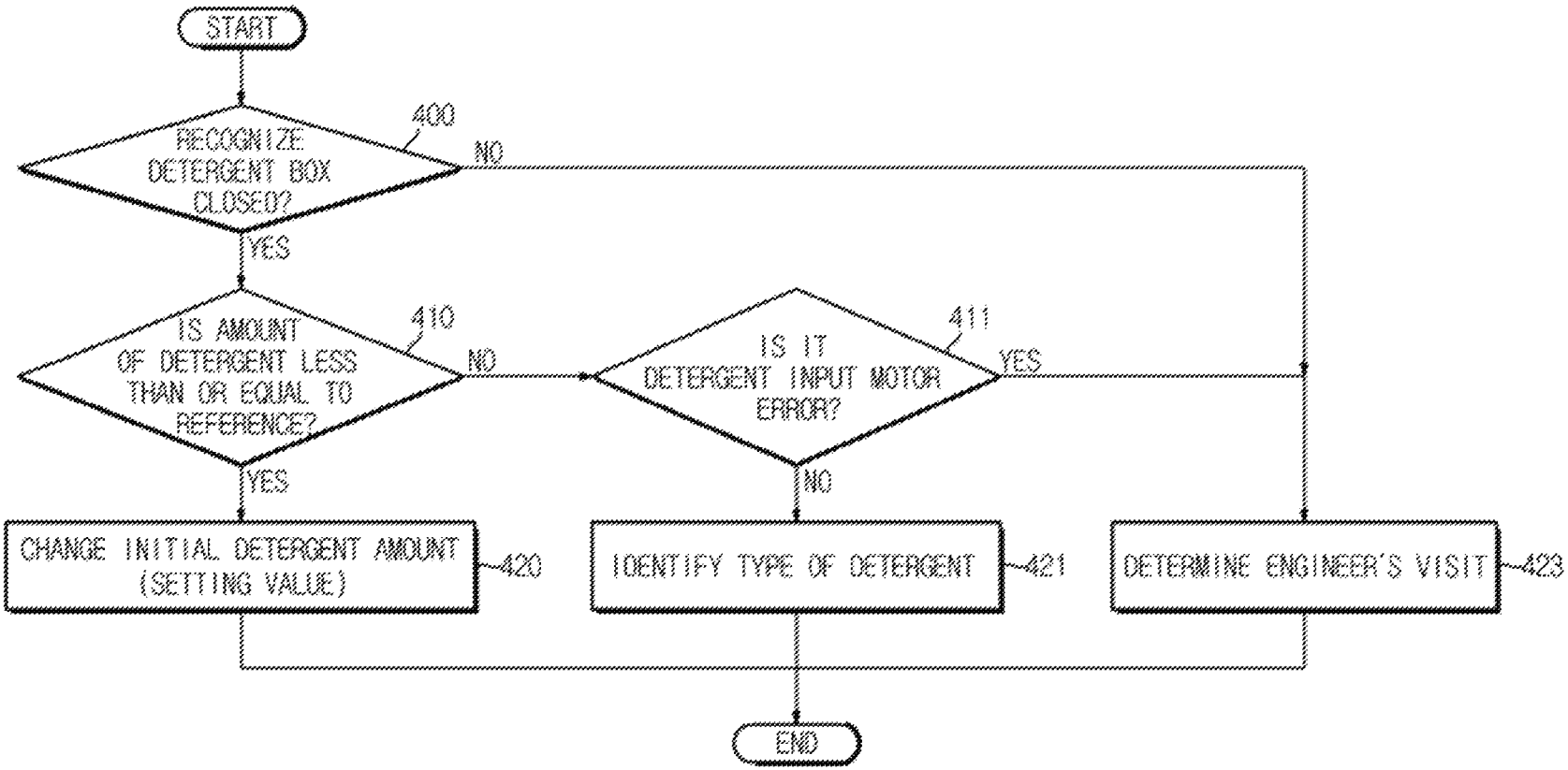
FIG. 9 is a flowchart illustrating a determination process of changing a setting value related to a detergent input function.

FIG. 9 is a flowchart illustrating a determination process of changing a setting value related to a detergent input function.

According to the user's fault inquiry may be subjected to the determination process as illustrated in FIG. 9.

In detail, the washing machine 1 may determine whether the detergent box 30 is closed (400).

Recognizing the closing of the detergent box 30 may depend on the detecting result of the sensing device 90 provided in the washing machine 1. The detection result may be determined based on the usage history transmitted by the washing machine 1.

When the washing machine 1 does not recognize the closing of the detergent box 30, the server 30 may determine that it cannot be solved by changing the setting value, and may determine the engineer's visit (423).

However, when the washing machine 1 recognizes that the detergent box 30 is closed, the server 30 may identify whether the amount of detergent input into the detergent box 30 is less than or equal to a reference value (410).

Here, the reference value may refer to a minimum amount of detergent for the detergent input motor 132 to operate. When the amount of detergent as a reference is insufficient, the washing machine 1 may not input the detergent in the washing process, and the user may determine this as the fault of the washing machine 1.

However, the fault may be solved by changing the reference value of the amount of detergent input as the reference to the operation of the washing machine 1. The washing machine 1 may solve the fault inquiry by changing the setting value of the initial detergent amount received from the outside (420).

On the other hand, when the amount of detergent more than the reference value is provided in the detergent box 30, the server 3 may identify through the usage history whether there is an error signal of the detergent input motor 132 (411).

When there is no an error history of the detergent input motor 132, the server 3 may identify the type of detergent to be used (421).

For example, the washing machine 1 may not be used a high concentration detergent. That is, even if there is no error in the detergent input motor 132, when the detergent is the high concentration detergent, the detergent may not be input. The server 3 may solve the fault inquiry by identifying the type of detergent to the user.

When the error of the detergent input motor 132 is identified, the server 3 may determine the engineer's visit (423).

That is, since the washing machine 1 can be controlled based on the setting value remotely transmitted from the server 3, that is, the external service center 4, it is possible to reduce the engineer's visit, thereby improving the convenience of the user and the economic benefit of the manufacturer.

The invention claimed is:

1. A washing machine comprising:

a drum;

a detergent box configured to contain a detergent;

a detergent input motor configured to transmit the contained detergent into the drum;

a communicator configured to communicate with a server;

a storage configured to store a setting value related to a function of the washing machine, a usage history of the washing machine, and a fault history; and a controller configured to:

control the communicator to transmit the stored setting value, usage history, and the fault history to the server based on a request signal received by the communicator, receive a setting value change signal including a changed setting value based on the usage history and the fault history, determine whether the setting value change signal is authorized to change the setting value of the washing machine, when the setting value change signal is an authorized signal, change update the setting value stored in the storage based on the received setting value change signal including the changed setting value, and control the washing machine based on the changed setting value, wherein the controller is further configured to:

based on the amount of detergent contained in the detergent box being smaller than a reference value of a minimum amount of detergent required for the detergent input motor to operate, control the detergent input motor so that the detergent is not input into the drum in a washing process, and change the reference value of the minimum amount of detergent in the detergent box necessary for operating the detergent input motor based on the received setting value.

2. The washing machine according to claim 1, further comprising:

a main body;

a door installation part having a front surface of the main body opened;

a door connected to the main body to open and close the door installation part; and a LED driver configured to emit light provided on one side of the door installation part, wherein the controller is further configured to control the LED driver based on the changed setting value.

3. The washing machine according to claim 1, further comprising:

a sound outputter configured to output a sound, wherein the controller is further configured to control on and off of the sound outputter based on the changed setting value.

4. The washing machine according to claim 1, further comprising:

a driving motor configured to rotate the drum, wherein the controller is further configured to adjust a reservation time for controlling the driving motor based on the changed setting value.

5. The washing machine according to claim 2, further comprising:

a door switch configured to selectively restrain an operation of the door when the door is closed, wherein the controller is further configured to control the door switch based on the changed setting value.

* * * * *